US012091948B2

(12) United States Patent
Skyler

(10) Patent No.: US 12,091,948 B2
(45) Date of Patent: Sep. 17, 2024

(54) NON-DETONABLE SHAPED CHARGE AND ACTIVATION

(71) Applicant: Schlumberger Technology Corporation, Sugar Land, TX (US)

(72) Inventor: David Skyler, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/067,202

(22) Filed: Dec. 16, 2022

(65) Prior Publication Data

US 2023/0121973 A1 Apr. 20, 2023

Related U.S. Application Data

(60) Continuation of application No. 16/600,905, filed on Oct. 14, 2019, now abandoned, which is a division of application No. 15/277,749, filed on Sep. 27, 2016, now Pat. No. 10,443,360.

(51) Int. Cl.

| | |
|---|---|
| ***E21B 43/117*** | (2006.01) |
| ***C06B 31/00*** | (2006.01) |
| ***E21B 43/1185*** | (2006.01) |
| ***F42B 1/02*** | (2006.01) |
| ***F42B 1/032*** | (2006.01) |
| ***F42B 1/036*** | (2006.01) |
| ***F42C 15/36*** | (2006.01) |
| ***F42C 15/38*** | (2006.01) |
| ***F42D 5/00*** | (2006.01) |

(52) U.S. Cl.

CPC ..... *E21B 43/117* (2013.01); *C06B 31/00* (2013.01); *E21B 43/1185* (2013.01); *F42B 1/02* (2013.01); *F42B 1/032* (2013.01); *F42B 1/036* (2013.01); *F42C 15/36* (2013.01); *F42C 15/38* (2013.01); *F42D 5/00* (2013.01)

(58) Field of Classification Search

None

See application file for complete search history.

(56) References Cited

U.S. PATENT DOCUMENTS 2,363,234 A 11/1944 Doll
3,034,393 A * 5/1962 Lieberman ..... F42B 1/036 102/306
3,094,069 A 6/1963 Hradel et al.
(Continued)

FOREIGN PATENT DOCUMENTS

WO 2012107834 8/2012

OTHER PUBLICATIONS

LA-UR-82-2020 Mumma, D.M., et al. "Geofrac—An explosives stimulation technique for a geothermal well" 1982.

(Continued)

*Primary Examiner* — Aileen B Felton

(74) *Attorney, Agent, or Firm* — Jeffrey D. Frantz

(57) ABSTRACT

A non-detonable shaped charge capable of becoming detonable upon activation. The shaped charge may be utilized for use with a perforating gun in oilfield applications. In this regard, during transport and other handling in advance of reaching the application site, the charge may be non-detonable. However, upon an intentionally directed activation, such as through heating, the shaped charge may be detonable.

21 Claims, 6 Drawing Sheets

(56) References Cited

U.S. PATENT DOCUMENTS

| | | | | |
|---|---|---|---|---|
| 4,248,303 | A | 2/1981 | Charpentier | |
| 4,274,893 | A * | 6/1981 | Mars | C06B 47/00 149/70 |
| 4,884,506 | A | 12/1989 | Guerreri | |
| 5,159,146 | A | 10/1992 | Carisella et al. | |
| 5,392,860 | A | 2/1995 | Ross | |
| 5,750,057 | A | 5/1998 | Brown et al. | |
| 5,850,053 | A * | 12/1998 | Scheffee | C06B 31/32 149/19.91 |
| 6,336,408 | B1 | 1/2002 | Parrott et al. | |
| 2003/0037692 | A1 | 2/2003 | Liu | |
| 2005/0056459 | A1 * | 3/2005 | Haney | E21B 43/117 175/4.6 |
| 2005/0087344 | A1 | 4/2005 | Toekje et al. | |
| 2007/0240880 | A1 | 10/2007 | Olsen | |
| 2009/0183916 | A1 | 7/2009 | Pratt et al. | |
| 2013/0118805 | A1 | 5/2013 | Moody-Stuart et al. | |
| 2016/0230524 | A1 | 8/2016 | Dumoit et al. | |
| 2018/0087353 | A1 | 3/2018 | Skyler | |
| 2020/0048997 | A1 | 2/2020 | Skyler | |

OTHER PUBLICATIONS

LA-UR-80-1713 Hanold, R.J. "Explosive stimulation of a geothermal well at the Geysers" 1980.
Meyer, Rudolf, et al "Explosives"; 2007 p. 348.

* cited by examiner

NON-DETONABLE SHAPED CHARGE AND ACTIVATION

CROSS-REFERENCE TO RELATED APPLICATIONS

The present application is a continuation of co-pending U.S. patent application Ser. No. 16/600,905, filed Oct. 14, 2019, which is a divisional of U.S. patent application Ser. No. 15/277,749, filed 27 Sep. 2016, now U.S. Pat. No. 10,443,360, which is herein incorporate by reference.

BACKGROUND

Field

The present disclosure relates to techniques for perforating a well. More particularly, the present disclosure relates to tools and methods for perforating a well with a non-detonable shaped charge.

Description of the Related Art

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and architecture may increase the likelihood of accessing underground hydrocarbon reservoirs, other challenges are presented in terms of well management and the maximization of hydrocarbon recovery from such wells. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Indeed, a variety of isolating, perforating and stimulating applications may be employed in conjunction with completions operations.

In the case of perforating, different zones of the well may be outfitted with packers and other hardware, in part for sake of zonal isolation. Thus, wireline or other conveyance may be directed to a given zone and a perforating gun employed to create perforation tunnels through the well casing. As a result, perforations may be formed into the surrounding formation, ultimately enhancing recovery therefrom.

The described manner of perforating requires first that the perforating gun be loaded with a number of explosive components, generally referred to as "shaped charges". Shaped charge components usually include an explosive material mixture that is housed within a casing with a liner provided there-over. The explosive mixture is often a dry compressed material mixture that is configured to be detonated on-demand. Once the gun is individually loaded with a host of charges and delivered downhole to a targeted location in the well, the charges may be remotely detonated from the oilfield surface by an operator. Upon detonation, each shaped charge may perform similar to a ballistic jet in forming an adjacent perforation. Further, this manner of operation is enhanced by the liner over the explosive which may serve to tailor the performance of the shaped charge in terms of the resulting adjacent perforation.

SUMMARY

A method of perforating a well is described wherein a shaped charge in a non-detonable state is loaded into a perforating gun. The gun is then advanced to a target location in the well where the shaped charge is now activated to a detonable state. The well may then be perforated at the target location with the charge. In one embodiment, the activating of the shaped charge to a detonable state is achieved through heat activating materials of the shaped charge to a fluid condition.

However, many modifications are possible without materially departing from the teachings of this disclosure. Accordingly, such modifications are intended to be included within the scope of this disclosure as defined in the claims.

BRIEF DESCRIPTION OF THE DRAWINGS

So that the manner in which the above recited features can be understood in detail, a more particular description may be had by reference to embodiments, some of which are illustrated in the appended drawings, wherein like reference numerals denote like elements. It is to be noted, however, that the appended drawings illustrate various embodiments and are therefore not to be considered limiting of its scope, and may admit to other equally effective embodiments.

DETAILED DESCRIPTION

Figure 1:
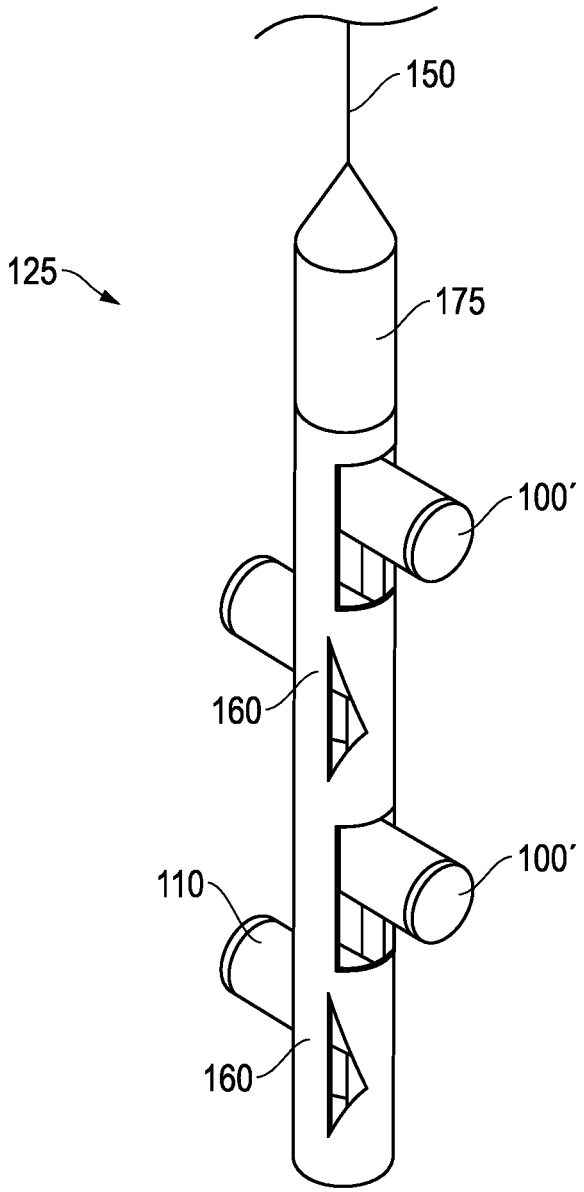
FIG. 1 is a perspective side view of a perforating gun accommodating embodiments of shaped charges transitioning from a non-detonable state.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Embodiments are described with reference to certain downhole perforating applications in vertical cased well environments. In particular, wireline deployed applications utilizing a perforating gun in the form of a pivot gun accommodating initially non-detonable shaped charges are detailed. However, other forms of deployment, gun types and well architectures may take advantage of non-detonable shaped charges as detailed herein. For example, horizontal or multi-zonal wells may benefit from shaped charges. Additionally, the perforating gun need not necessarily be a pivot gun. Regardless, so long as non-detonable shaped charges are employed that may be activated to a detonable state upon operator activation, appreciable benefit may be realized.

While fairly safe and effective for use downhole in the well, providing the end user at the oilfield with a multitude of shaped charges requires shipping of the explosives to the oilfield site. Thus, the challenge of safely shipping explosives is presented. Naturally, along these lines, the generally more burdensome task of obtaining governmental approval for the shipping of the explosives is also presented. As a result, when it comes to supplying shaped charges to an operator at an oilfield, a host of shipping and handling related costs are incurred in order to ensure governmental approval for the shipping in addition to safety.

By way of example, the US Department of Transportation (DOT) may require a host of tests be applied to an intended shipment of shaped charges before the shipment is certified for transport. This may include burn, drop tests and others. For example, drop testing of shaped charges may be dropped from set heights and examined for potential discharge.

For some jurisdictions, the testing standards are such that the possibility of attaining certification for international transport is virtually non-existent. However, where the possibility of attaining certification is present, a variety of costly and time consuming efforts are generally undertaken in order to deal with the hazards to attain certification. These efforts may include the use of specialized packaging and other costly measures. Once more, a significant amount of added delay is presented in the form of ensuring regulatory compliance and certification. Indeed, depending on the jurisdiction overseeing the certification process, delays of up to 6 to 9 months are not uncommon. As a practical matter this often means that the shaped charge supplier is likely to lose out to a more local, potentially pre-certified, competitor that does not need to ship the explosive shaped charges as far.

Efforts have been undertaken that would prevent the shipping of the completed shaped charge explosive. For example, the explosive components may be shipped separately in an effort to minimize applicable transport regulations. However, an unreasonable burden is placed on field personnel if significant skill and preparation time is necessary in order to produce a shaped charge on site. Thus, as a practical matter, the operator is often more likely to simply select the more user-friendly route of acquiring more fully assembled shaped charges from a supplier that has already acquired the necessary shipping approval therefor.

A method of perforating a well is described wherein a shaped charge in a non-detonable state is loaded into a perforating gun. The gun is then advanced to a target location in the well where the shaped charge is now activated to a detonable state. The well may then be perforated at the target location with the charge. In one embodiment, the activating of the shaped charge to a detonable state is achieved through heat activating materials of the shaped charge to a fluid condition.

Referring now to FIG. 1, perspective side view of a perforating gun 125 is shown accommodating embodiments of shaped charges 100'. Specifically, in the embodiment shown, the charges 100' are housed within carriers 110 of the gun 125. Once more, with the carriers 110 extending laterally to project the charges 100' outward, the charges 100' may be in a detonable state. More specifically, as detailed further herein the charges may be detonable 100' following activation, as depicted, or non-detonable 100 at a prior point in time before the activation (e.g. see FIG. 2).

The change in state from a non-detonable state to a detonable shaped charge 100' may be the result of an activation such as the directed application of heat or other applied factors. Indeed, in the embodiment shown, the carriers 110 of the gun 125 are secured to a housing 175 of the gun 125 by way of hinges 160. Thus, in addition to the application of heat, a swinging open of the carriers 110 from a retracted position at the housing 175 to the depicted lateral position may also serve as a factor to enhance activating the charges 100' to the detonable state shown. For example, where heat and such a targeted movement are used to liquefy and mix shaped charge materials to attain a detonable state, such an embodiment may prove effective for activation. That is, as detailed below, a given non-detonable shaped charge 100 may include mixed or unmixed solid materials, such as compressed powders, that require heating and/or mixing for attaining a detonable state (see FIGS. 6 and 7). Of course, a variety of other types of activation may also be possible as also discussed below.

Continuing with reference to FIG. 1, the perforating gun 125 is shown secured to a conveyance in the form of wireline 150 for advancing into a well as also described further below. Thus, in an embodiment where heat activation of the shaped charges 100' is utilized, the wireline 150 may be equipped with a resistive heating line for directing heating of the charges 100' at the appropriate time for activation. Similarly, a heater or heating element may be incorporated into the gun 125 or provided adjacent thereto in order to attain the requisite heat for activation.

Additional forms of activation such as circulating a heated fluid to the perforating gun 125, initiating a chemical reaction at the charges 100', introducing a predetermined pressure and others may be available. Indeed, the particular activation may be a matter of a variety of factors such as the type of conveyance utilized. For example, in an embodiment where coiled tubing is utilized for the conveyance in place of wireline 150, a targeted circulation of steam through the coiled tubing to the gun 125 may be suitable.

Figure 2:
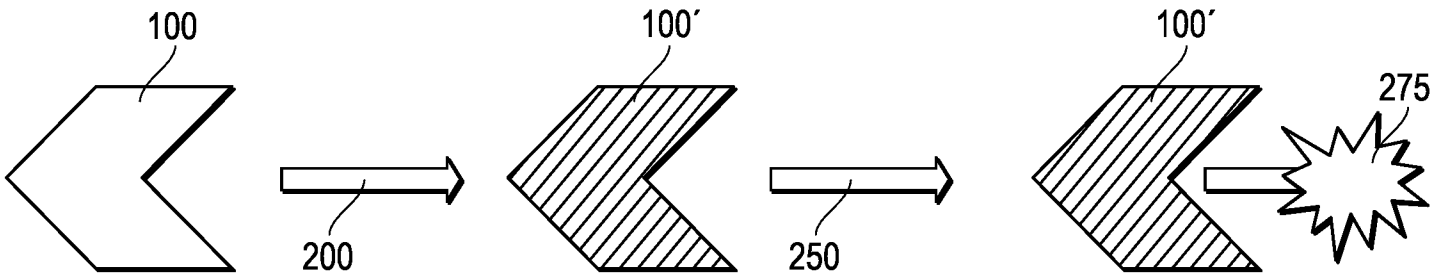
FIG. 2 is a schematic representation of a shaped charge moving from a non-detonable state to a detonable state for perforating.

Referring now to FIG. 2, a schematic representation of a shaped charge moving from a non-detonable state 100 to a detonable state 100' is shown. That is, the basic concept of a non-detonable shaped charge 100 for sake of shipping, manually loading into a perforating gun, or any other non-perforating task is shown. Thus, considering the potentially explosive nature of charges generally, a manner of enhancing both actual safety and shipping certification is provided due to the ability to handle a charge as a non-detonable shaped charge 100. The materials of such a non-detonable shaped charge 100 may remain inert during standard shipping certification such as drop testing. Of course, given the perforating purpose of charges, there is also the need to convert or "activate" the shaped charge 100 to a detonable form 100' for sake of initiation 250 and ultimately explosive perforating 275.

Continuing with reference to the schematic of FIG. 2, activating 200 of the shaped charge from non-detonable 100 to detonable 100' may be achieved in a variety of ways as suggested above. For example, heating of shaped charge materials may render a detonable shaped charge 100'. This may include specific targeted heating through a heating element or other suitable device structure. However, in an embodiment where the heat of a well at a downhole perforating location is substantially greater than heat during shipping or certification testing, the activating 200 may occur by simply delivering the charge 100 to the perforating location to attain the detonable form 100'.

Figure 5:
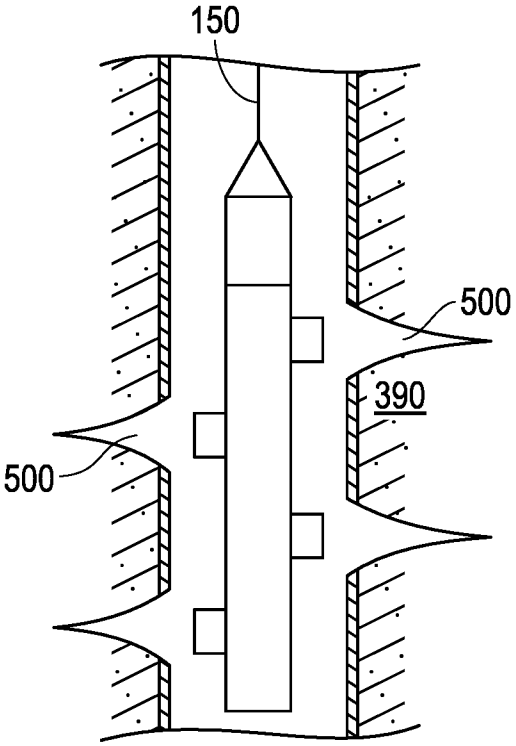
FIG. 5 is a side view of the perforating gun of FIG. 4 with the detonable shaped charges detonated to form perforations into a formation defining the well.
Figure 4:
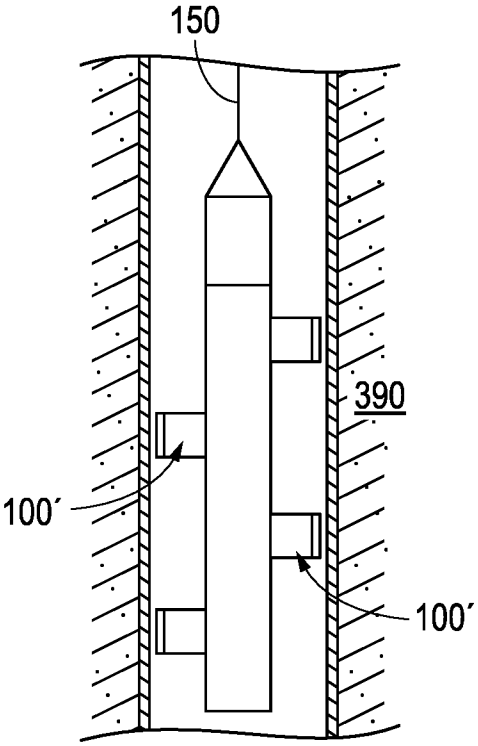
FIG. 4 is a side view of the perforating gun of FIG. 3 with the shaped charges thereof in a detonable state.
Figure 3:
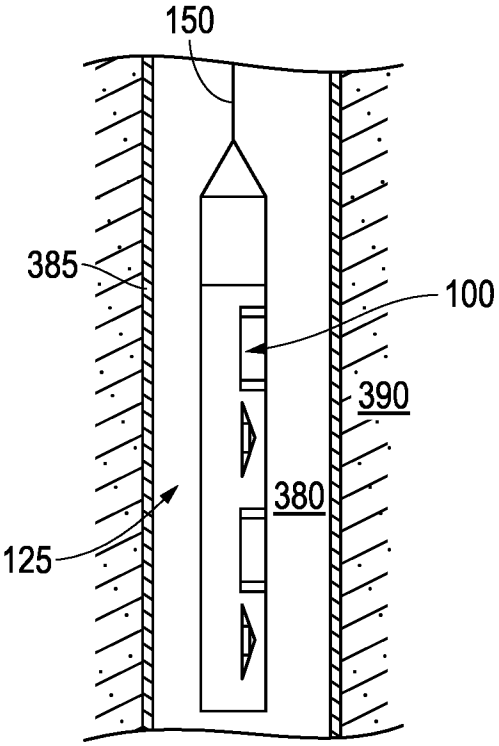
FIG. 3 is a side view of the perforating gun of FIG. 1 within a well and accommodating the shaped charges in a non-detonable state.

Referring now to FIGS. 3-5, an example embodiment of deploying the perforating gun 125 into a well 380, activating shaped charges 100' and forming perforations 500 is depicted. Specifically, with added reference to FIG. 1, FIG. 3 depicts deployment of the gun 125 into the well 380 with non-detonable shaped charges 100 of carriers 110 in a retracted position. FIG. 4 depicts the pivoted extension of the carriers 110 to laterally orient activated shaped charges 100' toward a formation 390 defining the well 380. That is, activation, whether through heating or other means, has transitioned non-detonable shaped charges 100 of FIG. 3 into the detonable shaped charges 100' of FIG. 4. Therefore, as shown in FIG. 5, the shaped charges 100' may be initiated to explosively form the perforations 500 depicted.

With specific reference to FIG. 3, the well 380 is provided with a casing 385 at the interface with the formation 390. The perforating gun 125 is shown lowered into the well 380 by wireline 150 to a targeted depth where perforations 500 are to be formed through the casing 385 and into the formation 390 as shown in FIG. 5. At this time, the charges may be non-detonable 100 as shown in FIG. 3. However, in other embodiments, heat or other well conditions at the target location or thereabove are of an activating character, the charges may already begin to take on a detonable state 100'. Regardless, with the perforating gun 125 of a pivot configuration, an overall diameter profile of 1-2 inches may be taken up by the gun 125 with the carriers 110 and charges 100 in a retracted position as shown. Considering that the diameter of the well may be under 12 inches or so, this minimal gun profile may be advantageous during the depicted deployment.

Continuing with reference to FIG. 4, in an embodiment where activating of the charges to a detonable state 100' has been initiated, it may be of benefit to pivot the carrier housed charges 100' as shown. That is, enlarging the gun profile to say, 3-4 inches by pivotally extending the carrier housed charges 100' as shown generally takes place once the target location is reached. Thus, this is not a hindrance to deployment. Further, this hinge-like pivotal extension may be of benefit to the activating process. For example, this may be the case where perforating performance is ultimately enhanced by mixing or agitating of the materials through such a pivoting movement. This is discussed in further detail below where potential material choices and constructions are detailed in reference to FIGS. 6 and 7.

Referring now to FIG. 5, with the detonable shaped charges 100' now in a lateral perpendicular orientation, directed at the casing 385 and formation 390, detonation may take place. More specifically, as alluded to above, a signal may be transmitted from surface and through the wireline 150 to trigger initiation of charge firing to form the depicted perforations 500.

Figure 6:
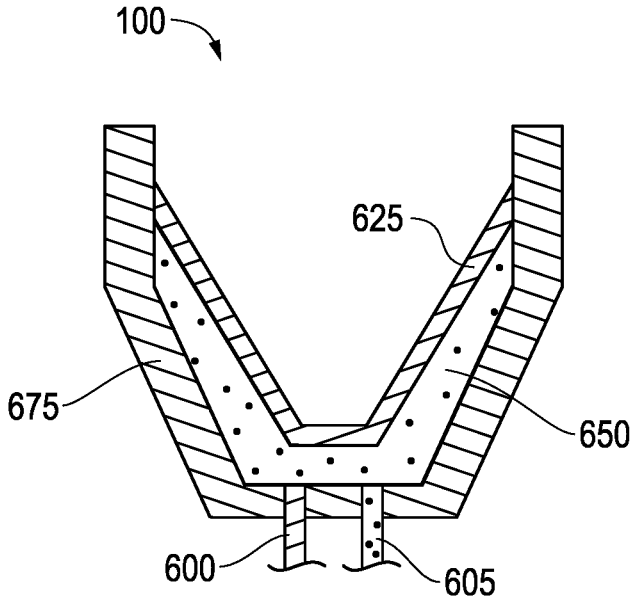
FIG. 6 is a side cross-sectional view of an embodiment of a non-detonable shaped charge tailored to take on a detonable state upon activation thereof.
Figure 7:
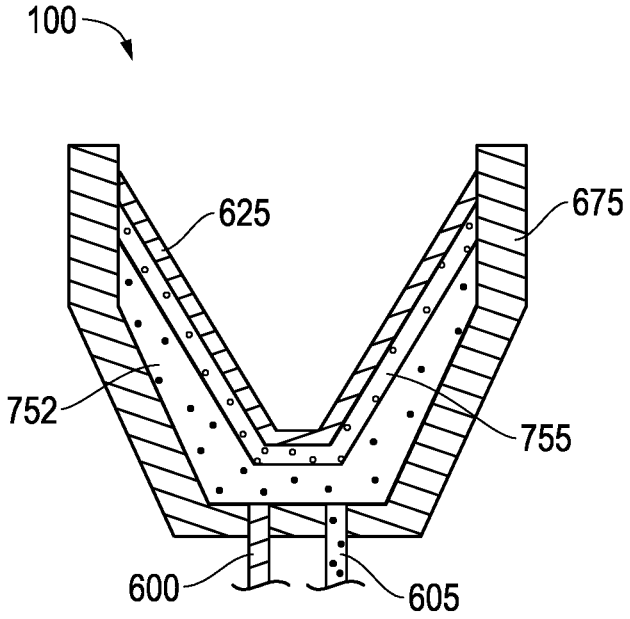
FIG. 7 is a side cross-sectional view of another embodiment of a non-detonable shaped charge tailored to take on a detonable state upon activation thereof.

With the general concept of a shaped charge moving from a non-detonable state 100 to a detonable state 100', specific reference is now drawn to FIGS. 6 and 7. Specifically, different construction, assembly and material possibilities are illustrated that may be employed for attaining a non-detonable shaped charge 100 that is capable of being activated into a detonable state 100' as discussed above. As used herein, the term "non-detonable" is meant to infer a state at which a given charge 100 would not be prone to detonate during handling or actual transport. Stated another way, absent activation, a non-detonable shaped charge 100 is substantially unlikely, if not completely incapable of detonating regardless of the rigors of standard conditions during transporting and/or handling protocols.

With specific reference now to FIG. 6, a side cross-sectional view of an embodiment of a non-detonable shaped charge 100 is shown. In this embodiment, the charge 100 is tailored to take on a detonable state upon activation thereof which is directed at a solid mixture 650. For example, the mixture 650 may be a compressed powder mix of both oxidizer and fuel components. However, in contrast to a conventional shaped charge, the particular oxidizer and fuel components as well as the overall characteristics of the mixture 650, a non-detonable state remains. Along these lines, in one embodiment, a eutectic mixture of oxidizer and fuel is selected that requires heating to between about 150° F. and 440° F. in order to attain activation to a detonable state. Given that unintentional exposure to such temperatures is not expected during transport and handling, the shaped charge 100 would be considered non-detonable absent activation such as the intentional heating of the mixture 650.

Continuing with reference to FIG. 6, heating of the mixture 650 may be achieved through a thermal line 600. For example, the perforating gun 125 of FIG. 1 may be outfitted with, or coupled to, a heating element or carry a resistive heating line from surface. Therefore, heat may be delivered from such a component to the mixture 650 via the depicted thermal line 600. In this manner, the mixture 650 may be heated to in excess of 150° F., for example, to attain activation for the embodiment noted above. That is, for this embodiment, once the mixture has achieved a temperature of between about 150° F. and 440° F., the shaped charge 100 will be in a detonable state 100' and may be effectively detonated (see FIG. 2).

The shaped charge 100 of FIG. 6 is equipped with other conventional features such as a casing 675 to retain the mixture 650. A liner 625 is also provided to seal off the mixture 650 and to help tailor characteristics of the attained perforation 500 once the shaped charge is detonated (e.g. see FIG. 5). Further, a conventional detonation cord 605 is provided to allow for the triggered initiation of the noted detonation.

As noted above, the mixture 650 of FIG. 6 may be a eutectic mix of oxidizer and fuel. That is, the mixture 650 may have a eutectic point at which the components melt which is lower than the melting point of the individual components. Further, in such an embodiment, attaining this molten state through heating as described above may serve to provide activation and take the mix from a non-detonable character to a detonable character. The mixture may be composed of an organic fuel and an inorganic oxidizer. In an embodiment, fuel components such as acetamide and guanidinium nitrate may be mixed with oxidizers such as potassium perchlorate and/or ammonium nitrate to achieve such an initially non-detonable eutectic mixture 650 capable of being heated to a detonable state. Other nitrates such as lithium nitrate, sodium nitrate and potassium nitrate may also be utilized as oxidizers for such eutectic mixtures.

Heating of the mixture 650 in order to achieve activation is advantageous where the activating temperature exceeds temperatures likely to be encountered during standard handling and transport situations. That is, the shaped charge 100 remains safely stable and inert until loaded and intentionally heated as discussed above. As a practical matter, the charge 100 will not encounter temperatures in excess of 150° F. during standard transport. Heating may also provide the added advantage of melting, agitating and further mixing the mixture 650. That is, similar to the pivoting action of a carrier 110 as noted above with respect to FIG. 4, the heating itself may also provide a degree of enhancement to the mixing of the mixture 650.

With specific reference to FIG. 7, a side cross-sectional view of another embodiment of a non-detonable shaped charge 100 is shown. In this embodiment, a single mixture 650 of oxidizing and fuel components is not provided. Instead, for example, to further ensure the non-detonable character of the charge 100, the components are separately provided. More specifically, a fuel component layer 752 may be provided adjacent a discretely separate oxidizer layer 755. Separately providing the layers 752, 755 in this manner means that mixing of the materials from the layers 752, 755 is a prerequisite to the activation. Of course, heating of the layers 752, 755 via the thermal line 600 may be sufficient to achieve both a melted mixing and activation as described above.

In other embodiments, the materials of the layers 752, 755 may be provided separately to the operator for assembly. For example, the operator may attain shipments of casings 675 with fuel layers 752 thereon while also attaining shipments of separate liners 625 with oxidizer layers 755 thereon. In such an embodiment, the operator may snap-fit or otherwise assemble the liners 625 into the casings 675 before putting the assembled shaped charge 100 into the gun 125 (e.g. of FIG. 3). In still other embodiments, the materials of the layers 752, 755 may be provided in a form other than a solid powder for melting. This may include liquid layers 752, 755 separated by a degradable barrier or some other form of temporary isolating mechanism that may be removed to allow for mixing.

Additionally, the separate component layers 752, 755 need not be stacked in the fashion shown with one 752 secured to the casing 675 and the other secured to the liner 625. For example, the component layers 752, 755 may be provided side by side with one type of material at the left of the charge 100 as shown and the other separated to the right of the charge 100 as shown. Furthermore, regardless of orientation, to increase security and surface area for interaction, the interface between the layers 752, 755 may be of a jagged or uneven nature, whereby matching surfaces of the layers 752, 755 are mated together. Regardless, in the embodiment shown, once mixed, heat may be applied for activation so as to render a detonable shaped charge 100' (see FIG. 1).

Figure 8:
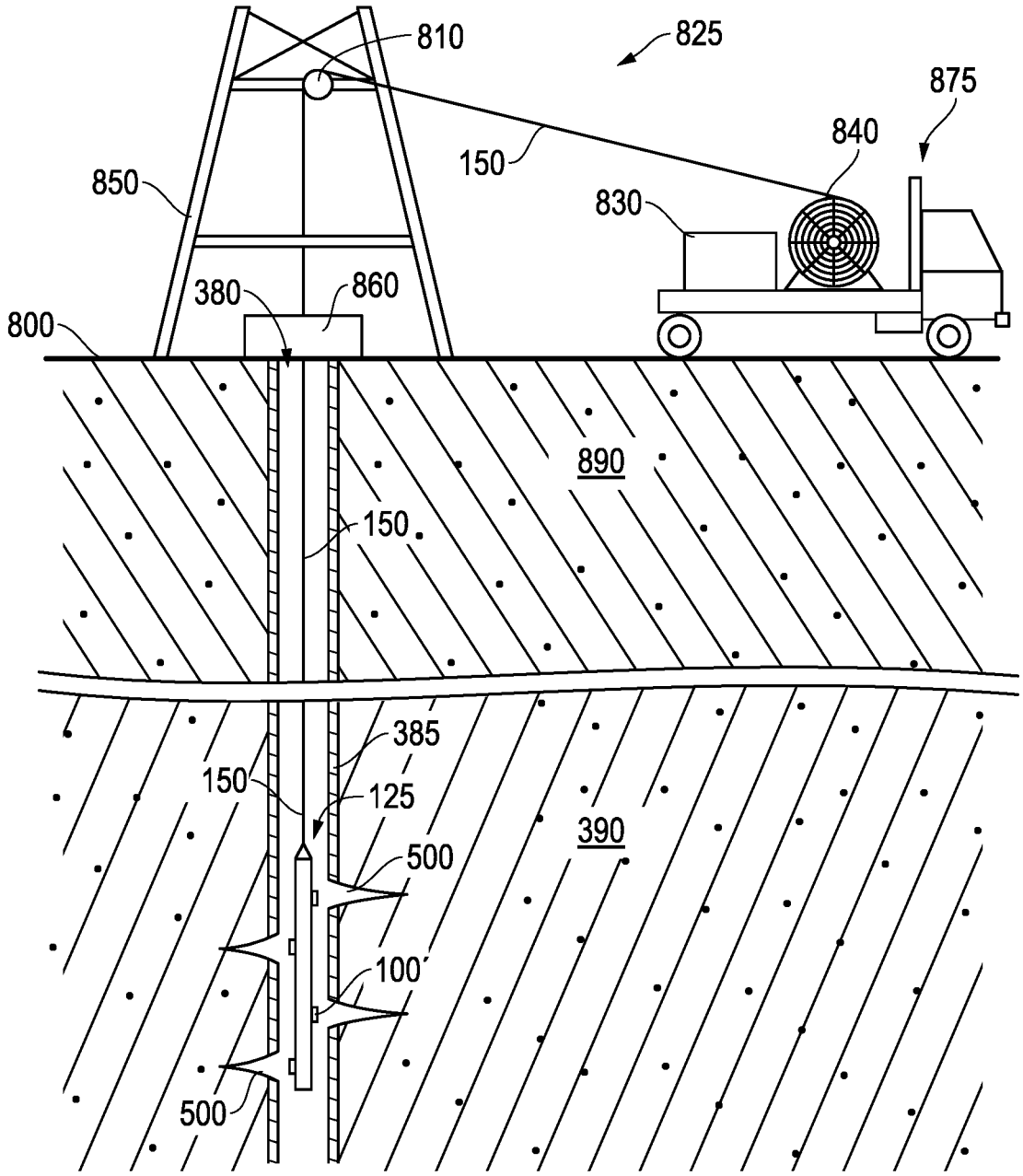
FIG. 8 is an overview depiction of an oilfield including the well of FIGS. 3-5 for accommodating the perforating gun of FIG. 1.

Referring now to FIG. 8, an overview depiction of an oilfield 800 is shown with the well 380 of FIGS. 3-5 for accommodating the perforating gun 125 of FIG. 1. In this view, the gun 125 is shown deployed through various formation layers 890, 390 before reaching a target area to form the depicted perforations 500. Delivering the perforating gun 125 may be achieved through a host of surface equipment 825. Specifically, in the embodiment shown, a mobile wireline truck 875 is shown with a reel 840 from which wireline 150 may be run to a rig 850 over the well 380. The wireline 150 is depicted strung over a sheave 810 of the rig 850 for dropping down past a wellhead 860 and into the well 380.

The deployment of the wireline 150 and perforating gun 125 may be directed through a control unit 830 provided by the depicted truck 875. Similarly, the control unit 830 may be used to direct activating the charges 100' to a detonable state. This may be achieved through heating or other means as described above as directed by the control unit 830. Further, once activated, the unit 830 may also direct initiation and firing of the gun 125 to form the perforations 500 through the casing 385 and into the formation 390. However, as described above, until the operator is ready, there is no particular need to have the charges 100' in such a state. Instead, prior to deployment, the charges 100' may remain in a safe non-detonable condition.

Figure 9:
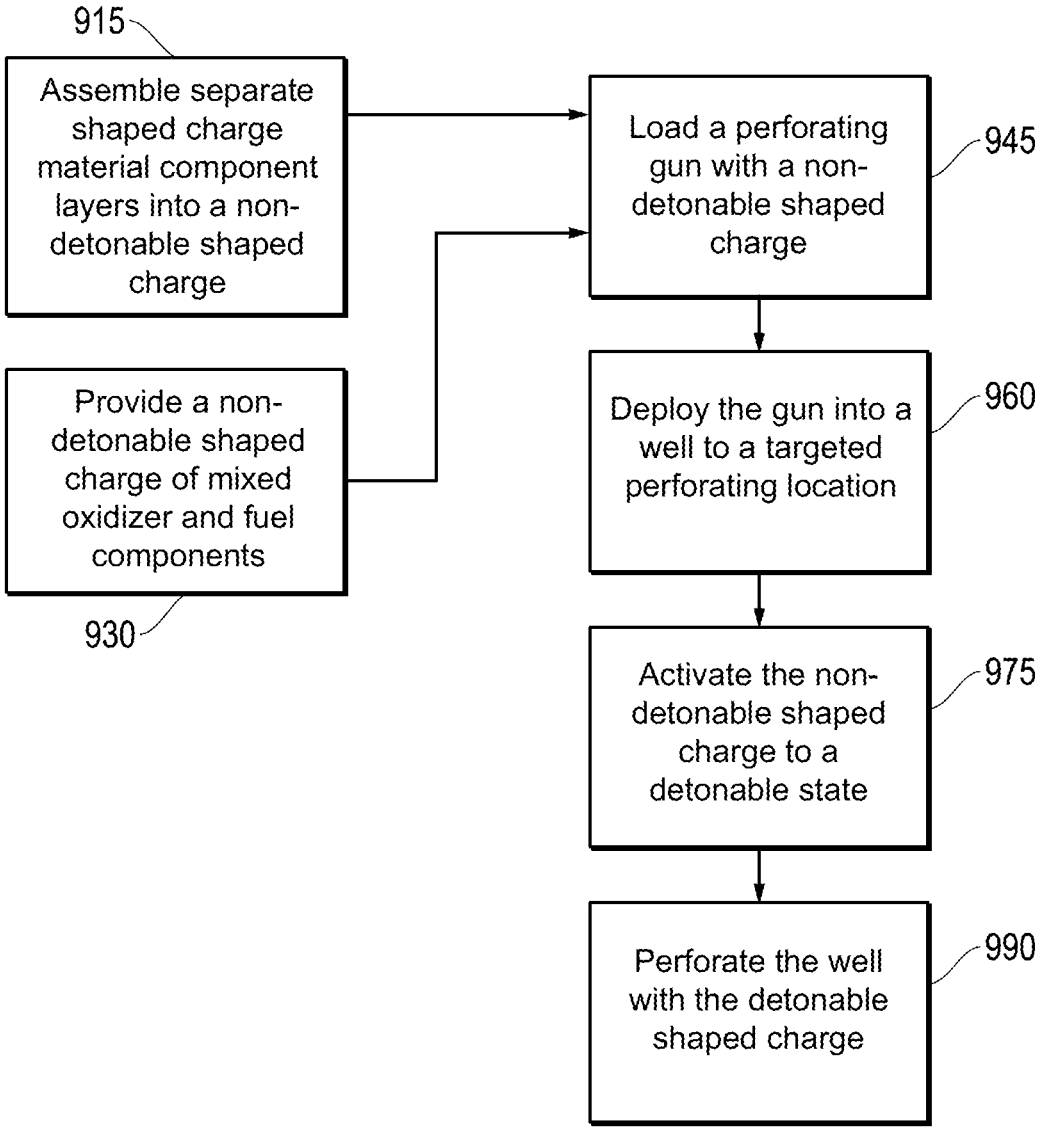
FIG. 9 is a flow-chart summarizing an embodiment of employing non-detonable shaped charges to perforate a well upon transitioning to a detonable state.

Referring now to FIG. 9, a flow-chart summarizing an embodiment of employing non-detonable shaped charges to perforate a well upon transitioning to a detonable state is shown. As depicted, non-detonable shaped charges may be assembled or provided either with separated layers (915) or as a single mixture of oxidizer and fuel (930). Regardless, the shaped charges may be shipped in a safe fashion all the way to the oilfield or other useable location in this non-detonable state where they are eventually loaded into a perforating gun as shown at 945. The gun may then be deployed into the well as indicated at 960 where the charges may be safely activated, for example through heat, as indicated at 975. Thus, once reaching the target location for perforating, the now detonable shaped charges may be used to perforate the well (see 690). Of course, other sequences for activation may be employed. For example, activation may take place only after reaching the target location for perforating or at another time of the operator's choosing. Regardless, when delivered to the operator for use at the oilfield, the shaped charges have been transported in a safe, non-detonable manner allowing the operator to take control over how and when to transition charges to a detonable state.

Embodiments described herein above include the use of shaped charges that are non-explosive for sake of transport. These non-detonable shaped charges are constructed to readily withstand the scrutiny of certification for shipping. Thus, time consuming delays and costly efforts to attain shipping approval in various jurisdictions may be substantially eliminated as well as the potential associated shipping hazards. Once more, after shipping, the shaped charges may be activated to a detonable state at the appropriate operator-determined time for sake of perforating a well. Thus, the shaped charges are both well suited for transport in a non-detonable state and well suited for a perforating application in a detonable state once the appropriate detonating time arises.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

The invention claimed is:

1. A shaped charge, comprising:

a carrier;

an oxidizer component housed within the carrier;

a fuel component housed within the carrier, wherein the oxidizer component and the fuel component are retained in a non-detonable state relative to one another; and a hinge coupled to an end of the carrier and supporting the carrier for pivotal movement, the carrier pivotal about the hinge between a first position and a second position, the carrier retaining the oxidizer component and the fuel component in the non-detonable state relative to one another while the carrier is in the first position, wherein the oxidizer component and the fuel component activate from the non-detonable state to a detonable state in response to an increase in temperature and the pivotal movement of the carrier about the hinge from the first position to the second position that mixes the oxidizer component and the fuel component within the carrier.

2. The shaped charge of claim 1, wherein the fuel component is an organic fuel.

3. The shaped charge of claim 1, wherein the oxidizer component is an inorganic oxidizer.

4. The shaped charge of claim 3, wherein the oxidizer component comprises at least one of ammonium nitrate, lithium nitrate, sodium nitrate, or potassium nitrate.

5. The shaped charge of claim 1, wherein the oxidizer component is a heat responsive compressed powder.

6. The shaped charge of claim 1, wherein the fuel component is a heat responsive compressed powder.

7. The shaped charge of claim 1, wherein at least one of the oxidizer component and the fuel component is a liquid in the non-detonable state.

8. The shaped charge of claim 1, further comprising a degradable barrier separating the fuel component and the oxidizer component in the non-detonable state.

9. A shaped charge, comprising:

a carrier;

an oxidizer component housed within the carrier;

a fuel component housed within the carrier; and a degradable barrier separating the oxidizer component and the fuel component to maintain, the oxidizer component and the fuel component in a non-detonable state relative to one another, wherein the oxidizer component and the fuel component activate from the non-detonable state to a detonable state in response to an increase in temperature, and wherein the increase in temperature induces mixing of the oxidizer component and the fuel component within the carrier.

10. The shaped charge of claim 9, further comprising:

the carrier retaining the oxidizer component, the fuel component, and the degradable barrier; and a hinge coupled to an end of the carrier and supporting the carrier for pivotal movement, the carrier pivotal about the hinge between a first position and a second position, the carrier retaining the oxidizer component and the fuel component in the non-detonable state relative to one another while the carrier is in the first position, wherein the oxidizer component and the fuel component are further configured to activate from the non-detonable state to the detonable state in response to the pivotal movement of the carrier that mixes the oxidizer component and the fuel component within the carrier.

11. The shaped charge of claim 9, wherein the oxidizer component and the fuel component activate from the non-detonable state to the detonable state in response to the temperature of the shaped charge being between about 150° F. and about 440° F.

12. The shaped charge of claim 9, further comprising a heating element.

13. The shaped charge of claim 1, wherein the oxidizer component and the fuel component are provided in a eutectic mixture in the non-detonable state.

14. The shaped charge of claim 13, wherein the increase in temperature induces the substantially solid eutectic mixture to reach a molten state.

15. The shaped charge of claim 9, wherein the fuel component is an organic fuel.

16. The shaped charge of claim 9, wherein the oxidizer component is an inorganic oxidizer.

17. A shaped charge, comprising:

a carrier;

an oxidizer component housed within the carrier;

a fuel component housed within the carrier, wherein the oxidizer component and the fuel component are retained in a non-detonable state relative to one another;

a degradable barrier separating the fuel component and the oxidizer component in the non-detonable state in the carrier; and a hinge coupled to an end of the carrier and supporting the carrier for pivotal movement, the carrier pivotal about the hinge between a first position and a second position, the carrier retaining the oxidizer component and the fuel component in the non-detonable state relative to one another while the carrier is in the first position, wherein the oxidizer component and the fuel component activate from the non-detonable state to a detonable state in response to an increase in temperature of the shaped charge and the pivotal movement of the carrier about the hinge from the first position to the second position that mixes the oxidizer component and the fuel component within the carrier.

18. The shaped charge of claim 17, wherein the increase in temperature induces mixing of the oxidizer component and the fuel component within the carrier.

19. The shaped charge of claim 17, wherein the fuel component is an organic fuel.

20. The shaped charge of claim 17, wherein the oxidizer component is an inorganic oxidizer.

21. The shaped charge of claim 1, wherein the carrier is oriented in a downhole direction in the first position, and wherein the carrier is oriented in a lateral direction toward a surface of a well in the second position.

* * * * *